United States Patent [19]

Livingston

[11] 3,999,788

[45] Dec. 28, 1976

[54] VEHICLE DOOR PUSH BUTTON PROTECTOR

[76] Inventor: Richard J. Livingston, R.D. No. 2 Lakeview Drive, West Middlesex, Pa. 16159

[22] Filed: July 2, 1975

[21] Appl. No.: 592,392

[52] U.S. Cl. ..... 292/1; 292/347; 292/DIG. 2

[51] Int. Cl.[2] ..... E05B 1/00

[58] Field of Search ..... 292/347, DIG. 2, 1, 292/336.3; 70/181

[56] References Cited

UNITED STATES PATENTS

| | | | |
|---|---|---|---|
| 2,708,845 | 5/1955 | Trammell, Jr. | 70/181 |
| 3,247,691 | 4/1966 | Martin | 292/DIG. 2 |
| 3,623,758 | 11/1971 | Trinca | 292/347 |

*Primary Examiner*—Paul R. Gilliam
*Assistant Examiner*—Kenneth J. Dorner
*Attorney, Agent, or Firm*—Michael Williams

[57] ABSTRACT

A vehicle door push button protector to prevent thieves or children from moving a locked push button to unlocked position.

The protector comprises a pair of telescoping sleeves, the outer sleeve being securable to the door trim. The sleeves are relatively movable in an axial direction and include selectively interengagable members which permit the inner sleeve to be pulled from within the outer sleeve to a position preventing access to the door push button.

4 Claims, 6 Drawing Figures

VEHICLE DOOR PUSH BUTTON PROTECTOR

BACKGROUND AND SUMMARY

Vehicles of present design have car door windows riding in rubber weather stripping to effect a seal against the elements. These rubber weather strippings, and especially the ones at the unhinged vertical part of either front door, have provided an unauthorized person easy access to the door lock button to move the same to open position by use of a coat hanger or a wire or flat metal member.

Further, when children are transported in the rear seat portion of the vehicle, the driver of the vehicle cannot watch their activity without neglecting his driving operations, and accidents have been caused by children pulling up on the easily accessible door lock button to unlock the door.

The prior art contains many patents which attempt to overcome the disadvantages of an unprotected door lock button but, insofar as I am aware, none has had commercial success because some are extremely complicated in design; others are unreliable; and yet others are costly to manufacture and install.

My invention provides a protector for a door lock button which is relatively simple and inexpensive and may be easily installed on practically all vehicles without special tools. The protector comprises a pair of telescoping sleeves, relatively movable in an axial manner. The outer sleeve is disposed within the car door and has its upper end secured to the horizontal window rail of the latter. The inner sleeve is axially movable from a position within the outer sleeve to a position wherein it extends outwardly of the latter and surrounds the door lock button. The sleeves have selectively interengagable members to hold the inner sleeve in its extended position.

DESCRIPTION OF THE DRAWING

In the drawing accompanying this specification and forming a part of this application, there is shown, for purpose of illustration, an embodiment which my invention may assume, and in this drawing.

DESCRIPTION OF THE PREFERRED EMBODIMENT

Figure 1:
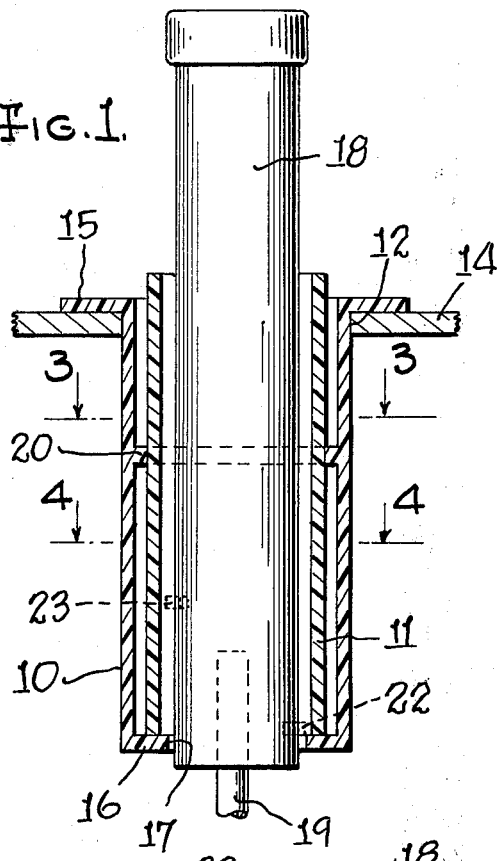
FIG. 1 is an enlarged longitudinal sectional view showing my improved protector in position wherein it permits normal operation of a door lock button.

My improved door lock button protector may be installed on any door of a vehicle and comprises an outer sleeve 10 and an inner sleeve 11 arranged for relative movement in an axial manner. The sleeves may be formed of any suitable rigid material, and a plastic material is presently preferred.

The outer sleeve 10 is adapted to extend through the usual opening 12 in the horizontal window rail 14 of the vehicle door. In some cases a trim grommet (not shown) is disposed within the opening 12, and this should preferably be removed. With the grommet removed, the opening 12 is usually of sufficient diameter to accomodate the sleeve 10, but if necessary the opening may be easily enlarged.

The outer sleeve has a peripheral flange 15 at its upper end and this flange is anchored to the window rail 14 in any suitable manner to prevent the sleeve from being pried upwardly. Cementing the flange 15 to the rail 14 may provide sufficient anchorage. The lower end of the outer sleeve 10 has an end wall 16 which is apertured at 17 to freely pass the usual push button 18. The push button is connected to the shift rod 19, the latter being adapted to operate the locking mechanism of the vehicle door in conventional manner.

Intermediate its ends, the outer sleeve 10 has an inner annular ledge 20 which has one or more slots 21 therein. Two slots 21 are herein disclosed, preferably diametrically opposed. The inner sleeve 11 has an external diameter to slidably fit through the opening in the annular ledge 20. At its lower end, the sleeve 11 has a pair of diametrically opposed lugs 22 extending outwardly therefrom, and a similar pair of lugs 23 is formed upwardly of the lugs 22. The lugs 22 and 23 are of a size to freely pass through the slots 21 in the ledge 20 and preferably the pairs of lugs 22 and 23 are out of alignment. The sleeve 11 has an inner diameter to freely receive the push button 18.

The sleeves 10 and 11 may be easily assembled, without tools, by inserting the lower end of the sleeve 11 into the upper end of the sleeve 10 until the lugs 22 engage the annular ledge 20. The sleeves are then relatively rotated to align the lugs 22 with the slots 21 to permit further insertion of the sleeve 11 until the lugs 23 engage the ledge 20. The sleeves are then relatively rotated to align the lugs 23 with the slots 21 to permit full insertion of the sleeve 11 to the position shown in FIG. 1. In this position, the upper end of the push button 18 is fully exposed for normal operation.

Figure 2:
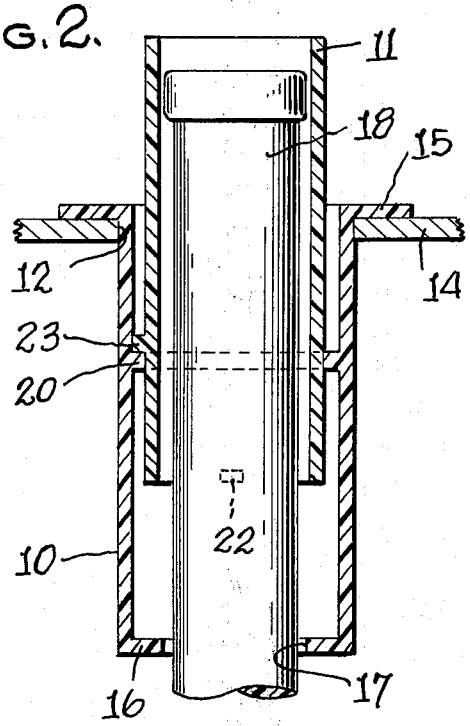
FIG. 2 is a view similar to FIG. 1 but showing the protector in position wherein it obstructs access to the door lock button.
Figure 3:
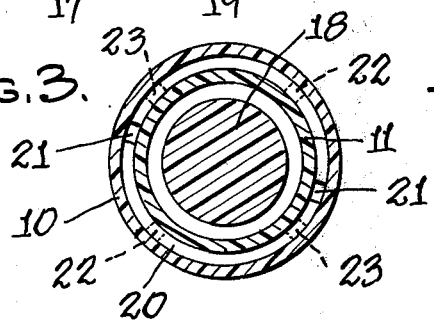
FIGS. 3 and 4 are transverse sectional views corresponding respectively to the lines 3—3 and 4—4 of FIG. 1, and FIGS. 5 and 6 are perspective views of the two sleeves which form the door lock button protector.
Figure 4:
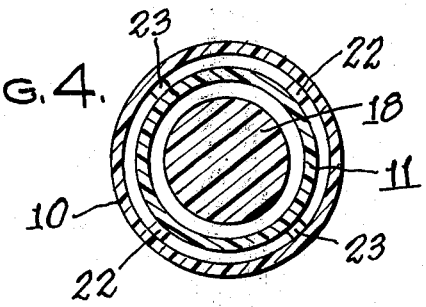
Figure 5:
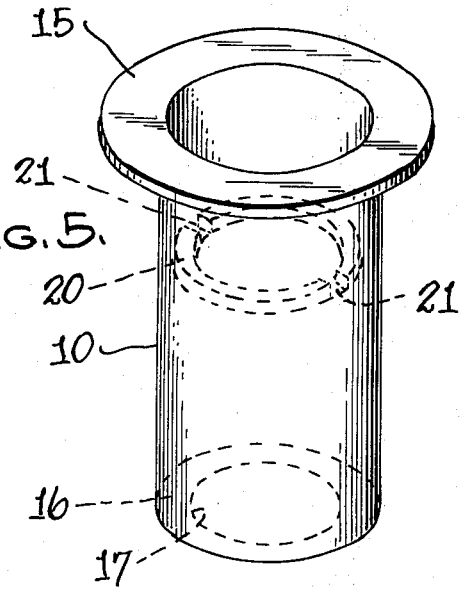
Figure 6:
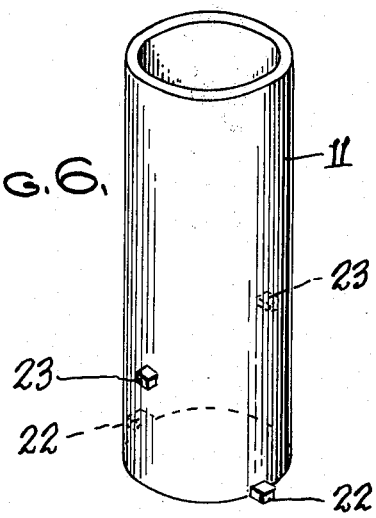

To lock the vehicle door, the push button 18 is moved to its depressed position shown in FIG. 2, either by a key or by manually pushing downwardly on the button. To protect the push button from unauthorized operation, the inner sleeve 11 is pulled upwardly until the lugs 23 engage the underside of the ledge 20, and then rotated so that the lugs 23 may be passed through the slots 21. Since the lugs 22, 23 are out of alignment, the sleeve 11 cannot be pulled out of the sleeve 10 unless the former is further rotated. The inner sleeve is then rotated so that the lugs 23 engage the upperside of the ledge 20, to thereby hold the inner sleeve in the position shown in FIG. 2. In such position, the upper end of the push button 18 which extends above the horizontal window rail 14 is completely surrounded by the sleeve 11 and since the latter has a smooth cylindrical outer surface, the tools normally used by thieves would be of no avail.

To return the inner sleeve 11 to the position of FIG. 1, it is merely necessary to rotate this sleeve drop to its lower position. The fact that the sleeve 11 has a smooth cylindrical outer surface, and that it must be rotated to uncover the push button, will make it difficult for small children to comprehend proper operating procedure.

I claim:

1. A protector for the push button of a vehicle door lock, which push button projects upwardly from a horizontal rail of the door and through an aperture therein and is movable vertically a limited amount to actuate a customary lock operating rod, comprising:

an outer sleeve adapted to extend through said aperture in said horizontal rail and to be secured to the latter against axial movement, and an inner sleeve through which said push button is adapted to extend in an axial manner for free movement with respect thereto, said inner sleeve being movable axially within said outer sleeve between a first position wherein its upper end is below the upper portion of said push button to expose the same for normal operation, and a second position wherein its upper end surrounds said push button upper portion and restricts access thereto, said outer and inner sleeves having selectively interengageable abutment members for holding said inner sleeve in said second position, and said outer and inner sleeves having further interengaging means for holding said inner sleeve in said first position.

2. The construction according to claim 1 wherein the said abutment member on said outer sleeve comprises a ledge extending radially inwardly thereof, and the said abutment member on said inner sleeve comprises a lug extending radially outwardly thereof.

3. A protector for the push button of a vehicle door lock, which push button projects upwardly from a horizontal rail of the door and through an aperture therein and is movable vertically a limited amount to actuate a customary lock operating rod, comprising:

an outer sleeve adapted to extend through said aperture in said horizontal rail and to be secured to the latter against axial movement, and an inner sleeve through which said push button is adapted to extend in an axial manner, said inner sleeve being movable axially within said outer sleeve from one position wherein its upper end is below the upper portion of said push button to expose the same for normal operation, and another position wherein its upper end surrounds said push button upper portion and restricts access thereto, said outer sleeve having an annular ledge intermediate its ends, said ledge extending radially inwardly from the inner surface of said outer sleeve, said ledge having a slot therein, and said inner sleeve having a lug projecting radially outwardly from its outer surface and adapted to pass through said ledge slot to permit said inner sleeve to move to said one position, said inner sleeve being moved to said other position by pulling upwardly thereon with said lug aligned with said slot to pass therethrough and being held in said other position by rotation of said inner sleeve to misalign said lug and slot so that said lug rests upon the upper surface of said ledge.

4. A protector for the push button of a vehicle door lock, which push button projects upwardly from a horizontal rail of the door and through an aperture therein and is movable vertically a limited amount to actuate a customary lock operating rod, comprising:

an outer sleeve adapted to extend through said aperture in said horizontal rail and to be secured to the latter against axial movement, and an inner sleeve through which said push button is adapted to extend in an axial manner, said inner sleeve being movable axially within said outer sleeve from one position wherein its upper end is below the upper portion of said push button to expose the same for normal operation to another position wherein its upper end surrounds said push button upper portion and restricts access thereto, said outer sleeve having a closure wall at its lower end, said wall being apertured to pass said push button, said outer sleeve further having an annular ledge intermediate its ends, said ledge extending radially inwardly from the inner surface of said outer sleeve and formed with a pair of spaced slots, whereby the lower end of said inner sleeve rests on said closure wall when said inner sleeve is in said one position, said inner sleeve having a first pair of lugs adjacent to its lower end and projecting radially outwardly from its outer surface and by rotation of said inner sleeve being alignable with said slots and adapted to pass therethrough, said inner sleeve also having a second pair of lugs intermediate its upper and lower ends and projecting radially outwardly from its outer surface and by rotation of said inner sleeve being alignable with said slots and adapted to pass therethrough, said first pair of lugs being adapted to abut the lower surface of said ledge to prevent said inner sleeve from being completely withdrawn from said outer sleeve, and said second pair of lugs being adapted to rest on the upper surface of said ledge to hold said inner sleeve in said other position.

* * * * *